US010617212B1

(12) United States Patent
Tsai

(10) Patent No.: US 10,617,212 B1
(45) Date of Patent: Apr. 14, 2020

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC. (TW)

( * ) Notice: Subject to any disclaimer, the term of this patent is extended or adjusted under 35 U.S.C. 154(b) by 0 days.

(21) Appl. No.: 16/255,895

(22) Filed: Jan. 24, 2019

(30) Foreign Application Priority Data

Dec. 17, 2018 (TW) ..... 107145447 A

(51) Int. Cl.
*A47C 4/28* (2006.01)
*A47C 3/12* (2006.01)

(52) U.S. Cl.
CPC ..... *A47C 4/286* (2013.01); *A47C 3/12* (2013.01)

(58) Field of Classification Search
CPC ..... A47C 4/286
See application file for complete search history.

(56) References Cited

U.S. PATENT DOCUMENTS

D752,890 S * 4/2016 Akkad ..... D6/368
9,532,652 B2 * 1/2017 Choi ..... A47C 4/286
10,182,655 B1 * 1/2019 Frankel ..... A47C 4/286
2003/0234561 A1 * 12/2003 Zheng ..... A47C 4/02 297/45
2007/0187998 A1 * 8/2007 Chen ..... A47C 4/44 297/45
2010/0164256 A1 * 7/2010 Salisbury ..... A47C 4/286 297/16.2
2011/0006564 A1 * 1/2011 Lougee ..... A47C 4/286 297/41
2013/0313865 A1 * 11/2013 Homans ..... A47C 4/30 297/16.1
2018/0035811 A1 * 2/2018 Frankel ..... A47C 4/286
2019/0104850 A1 * 4/2019 Frankel ..... A47C 4/06

FOREIGN PATENT DOCUMENTS

CN 206491543 U 9/2017

* cited by examiner

*Primary Examiner* — Timothy J Brindley
(74) *Attorney, Agent, or Firm* — Schmeiser, Olsen & Watts, LLP

(57) ABSTRACT

A folding chair includes left and right back rest rods, a central handle, left and right handrail rods, left and right frame rods, left and right back rest support rods, left and right rear rods, left and right rear crossing rods, left and right handrail support rods, left and right front rods, left and right front crossing rods, left and right handrail rotating elements, left and right back rest rotating elements, left and right support rod sliding elements, left and right rear rod sliding elements, left and right frame rotating elements, left and right handrail pivoting elements, left and right support rod sliding elements, left and right front pedals, left and right rear pedals, and a support portion, such that the folding chair can be folded and thus takes up less space.

5 Claims, 11 Drawing Sheets

FOLDING CHAIR

CROSS-REFERENCE TO RELATED APPLICATION

This non-provisional application claims priority under 35 U.S.C. § 119(a) on Patent Application No(s). 107145447 filed in Taiwan, R.O.C. on Dec. 17, 2018, the entire contents of which are hereby incorporated by reference.

FIELD OF THE INVENTION

The present disclosure relates to chairs and, more particularly, to a folding chair.

BACKGROUND OF THE INVENTION

A conventional chair which is lightweight and easy to move around indoors and outdoors is usually integrally formed from a tough, lightweight material to attain a predetermined height. Although it is easy to move the chair to a predetermined place or stack up such chairs not in use, the chair cannot be folded and thus is bulky and of a fixed shape. As a result, taking the chairs to any outdoor environment entails putting the chairs in an admissible, small area to the detriment of ease of storage. In short, the underlying drawbacks of the chair are as follows: bulky and not foldable.

SUMMARY OF THE INVENTION

It is an objective of the present disclosure to provide a folding chair in order to overcome the aforesaid drawbacks of the prior art.

In order to achieve the above and other objectives, the present disclosure provides a folding chair, comprising a left back rest rod, a right back rest rod, a central handle, a left handrail rod, a right handrail rod, a left frame rod, a right frame rod, a left back rest support rod, a right back rest support rod, a left rear rod, a right rear rod, a left rear crossing rod, a right rear crossing rod, a left handrail support rod, a right handrail support rod, a left front rod, a right front rod, a left front crossing rod, a right front crossing rod, a left handrail rotating element, a right handrail rotating element, a left back rest rotating element, a right back rest rotating element, a left support rod sliding element, a right support rod sliding element, a left rear rod sliding element, a right rear rod sliding element, a left frame rotating element, a right frame rotating element, a left handrail pivoting element, a right handrail pivoting element, a left support rod sliding element, a right support rod sliding element, a left front pedal, a right front pedal, a left rear pedal, a right rear pedal and a support portion, wherein the left handrail rod, the left handrail rotating element, the left back rest rod, the central handle, the right back rest rod, the right handrail rotating element and the right handrail rod are sequentially connected, allowing the left back rest rod and the right back rest rod to be pivotally connected to each other by the central handle, the left handrail rod being pivotally connected to the left back rest rod by the left handrail rotating element, and the right handrail rod being pivotally connected to the right back rest rod by the right handrail rotating element, wherein an upper end of the left back rest support rod is pivotally connected to the left back rest rod by the left back rest rotating element, an upper end of the right back rest support rod is pivotally connected to the right back rest rod by the right back rest rotating element, a lower end of the left back rest support rod is pivotally connected to an upper end of the left rear rod and a rear end of the left frame rod by the left rear rod sliding element, a lower end of the right back rest support rod is pivotally connected to an upper end of the right rear rod and a rear end of the right frame rod by the right rear rod sliding element, wherein an upper end of the left rear crossing rod and an upper end of the left front rod are movably connected to the left back rest support rod by the left support rod sliding element, an upper end of the right rear crossing rod and an upper end of the right front rod are movably connected to the right back rest support rod by the right support rod sliding element, wherein a lower end of the left rear crossing rod is pivotally connected to a lower end of the right rear rod by the right rear pedal, a lower end of the right rear crossing rod is pivotally connected to a lower end of the left rear rod by the left rear pedal, a middle segment of the left rear crossing rod is pivotally connected to a middle segment of the right rear crossing rod, wherein a middle segment of the left front rod is pivotally connected to a middle segment of the left frame rod, and a middle segment of the right front rod is pivotally connected to a middle segment of the right frame rod, wherein a lower end of the left front rod is pivotally connected to a lower end of the right front crossing rod by the left front pedal, a lower end of the left handrail support rod is pivotally connected to and slid along the left front rod by the left support rod sliding element, a lower end of the right front rod is pivotally connected to a lower end of the left front crossing rod by the right front pedal, a lower end of the right handrail support rod is pivotally connected to and slid along the right front rod by the right support rod sliding element, and a middle segment of the left front crossing rod is pivotally connected to a middle segment of the right front crossing rod, wherein an upper end of the left handrail support rod is pivotally connected to the left handrail rod by the left handrail pivoting element, and an upper end of the right handrail support rod is pivotally connected to the right handrail rod by the right handrail pivoting element, wherein a front end of the left frame rod and an upper end of the left front crossing rod are movably connected to the left handrail support rod by the left frame rotating element, wherein a front end of the right frame rod and an upper end of the right front crossing rod are movably connected to the right handrail support rod by the right frame rotating element, and wherein the support portion is disposed at the left back rest rod, the right back rest rod, the left handrail rod, the right handrail rod, the left frame rod and the right frame rod.

In an embodiment of the present disclosure, the left back rest rotating element comprises a sleeve portion and a pivotal portion connected to the sleeve portion, the sleeve portion being disposed at the left back rest rod, the left back rest support rod being pivotally connected to the left back rest rod through the pivotal portion, the right back rest rotating element comprising a sleeve portion and a pivotal portion connected to the sleeve portion, the sleeve portion being disposed at the right back rest rod, and the right back rest support rod being pivotally connected to the back rest rod through the pivotal portion.

In an embodiment of the present disclosure, the left rear crossing rod and the left front rod are pivotally connected to the left support rod sliding element, the left support rod sliding element being slidingly, fittingly disposed at the left back rest support rod, wherein the right rear crossing rod and the right front rod are pivotally connected to the right support rod sliding element, the right support rod sliding element being slidingly, fittingly disposed at the right back rest support rod.

In an embodiment of the present disclosure, the lower end of the left back rest support rod is pivotally connected to the rear end of the left frame rod, whereas the left rear rod sliding element has a sleeve portion and a pivotal portion, and an upper end of the left rear rod is slidingly, fittingly disposed at the pivotal portion and thereby pivotally connected to the sleeve portion, wherein an upper end of the left rear rod is pivotally connected to the rear end of the left frame rod by the pivotal portion, with the sleeve portion fitting around the left back rest support rod, wherein the lower end of the right back rest support rod is pivotally connected to the rear end of the right frame rod, wherein the right rear rod sliding element has a sleeve portion and a pivotal portion, whereas an upper end of the right rear rod is slidingly, fittingly disposed at the pivotal portion, pivotally connected to the sleeve portion, and pivotally connected to the rear end of the right frame rod through the pivotal portion, with the sleeve portion fitting around the right back rest support rod.

In an embodiment of the present disclosure, the front end of the left frame rod is pivotally connected to the left frame rotating element, the upper end of the left front crossing rod is pivotally disposed at the left frame rotating element, the front end of the right frame rod is pivotally connected to the right frame rotating element, the upper end of the right front crossing rod is pivotally disposed at the right frame rotating element.

The folding chair of the present disclosure comprises a left handrail rotating element, right handrail rotating element, left back rest rotating element, right back rest rotating element, left support rod sliding element, right support rod sliding element, left rear rod sliding element, right rear rod sliding element, left frame rotating element and right frame rotating element and thus can fold so as to change from an unfolded state to a folded state, take up less space and is easy to transport and store.

DETAILED DESCRIPTION OF THE PREFERRED EMBODIMENTS

Objectives, features, and advantages of the present disclosure are hereunder illustrated with specific embodiments in conjunction with the accompanying drawings. The present disclosure can be implemented or applied in accordance with any other variant embodiments. Various modifications and changes may be made to the details described in the specification from different perspectives and for different applications without departing from the spirit of the present disclosure. The accompanying drawings are deemed illustrative and thus are not drawn to scale. The embodiment presented below is illustrative of the technical features of the present disclosure rather than restrictive of the claims of the present disclosure.

Figure 1:
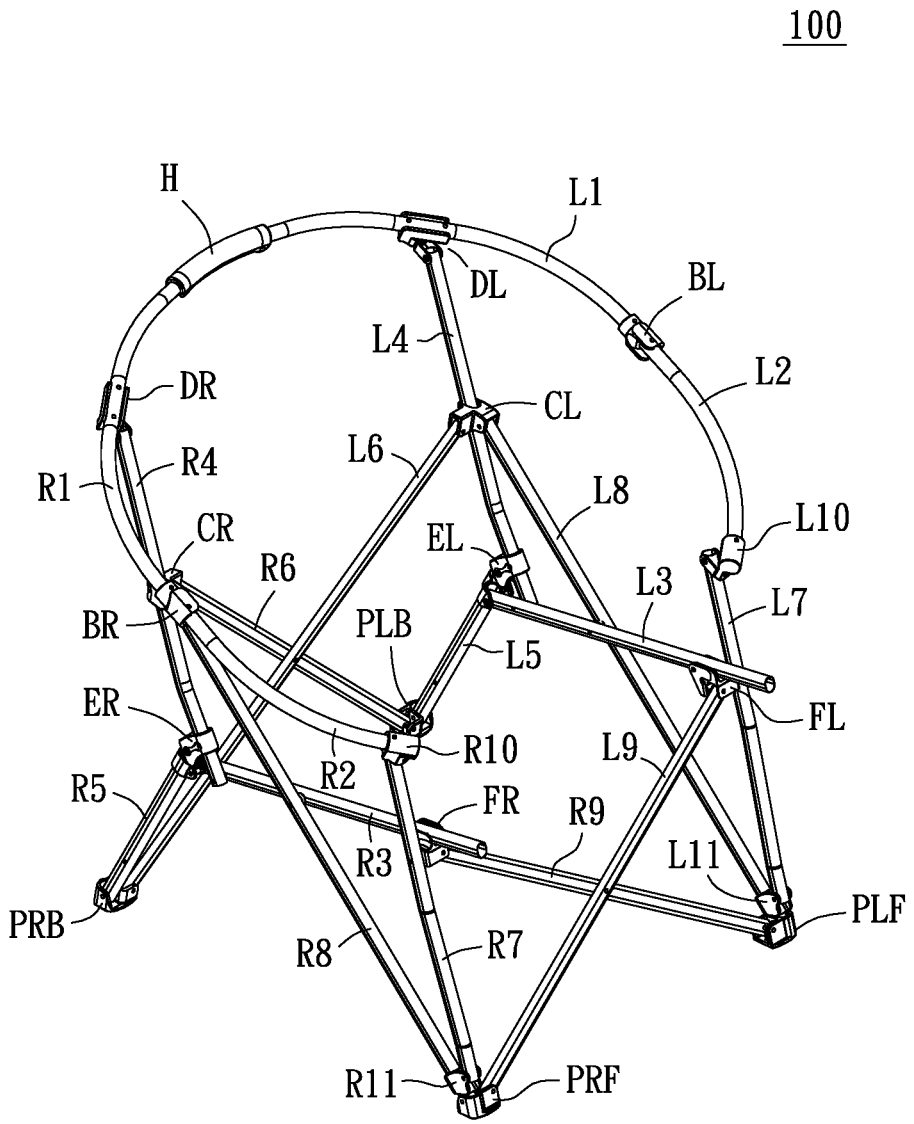
FIG. 1 is a perspective view of a folding chair according to an embodiment of the present disclosure.
Figure 2:
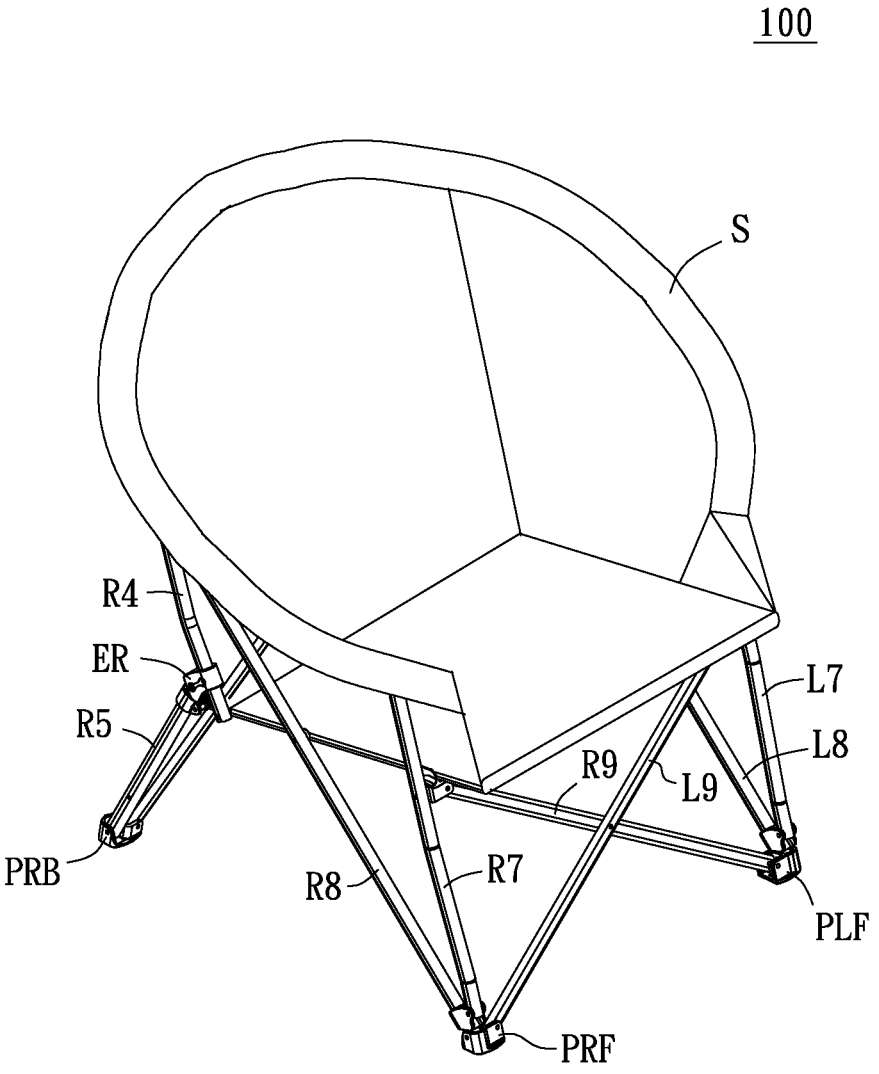
FIG. 2 is a perspective view of the folding chair according to the embodiment of the present disclosure, showing a support portion of the folding chair.
Figure 3:
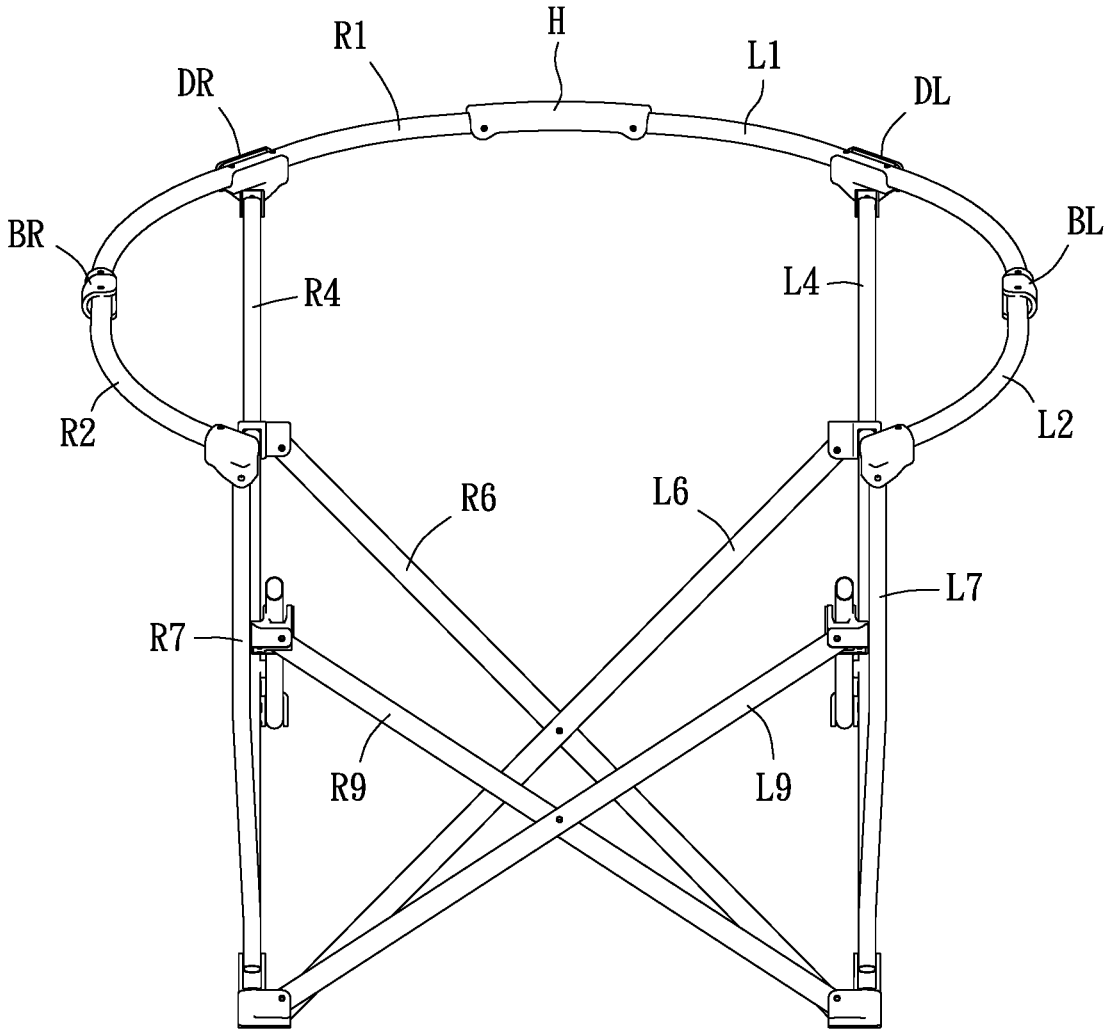
FIG. 3 is a front view of the folding chair according to the embodiment of the present disclosure.
Figure 4:
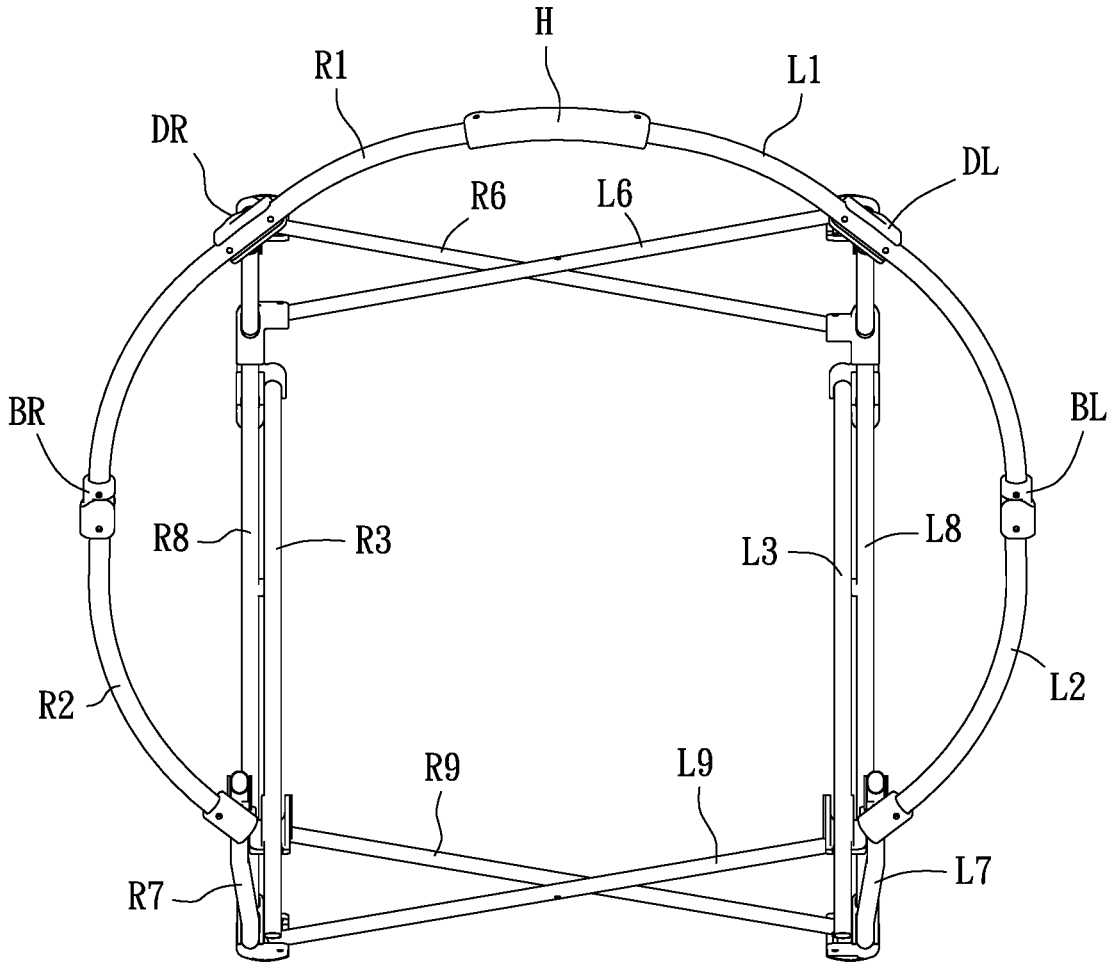
FIG. 4 is a top view of the folding chair according to the embodiment of the present disclosure.
Figure 5:
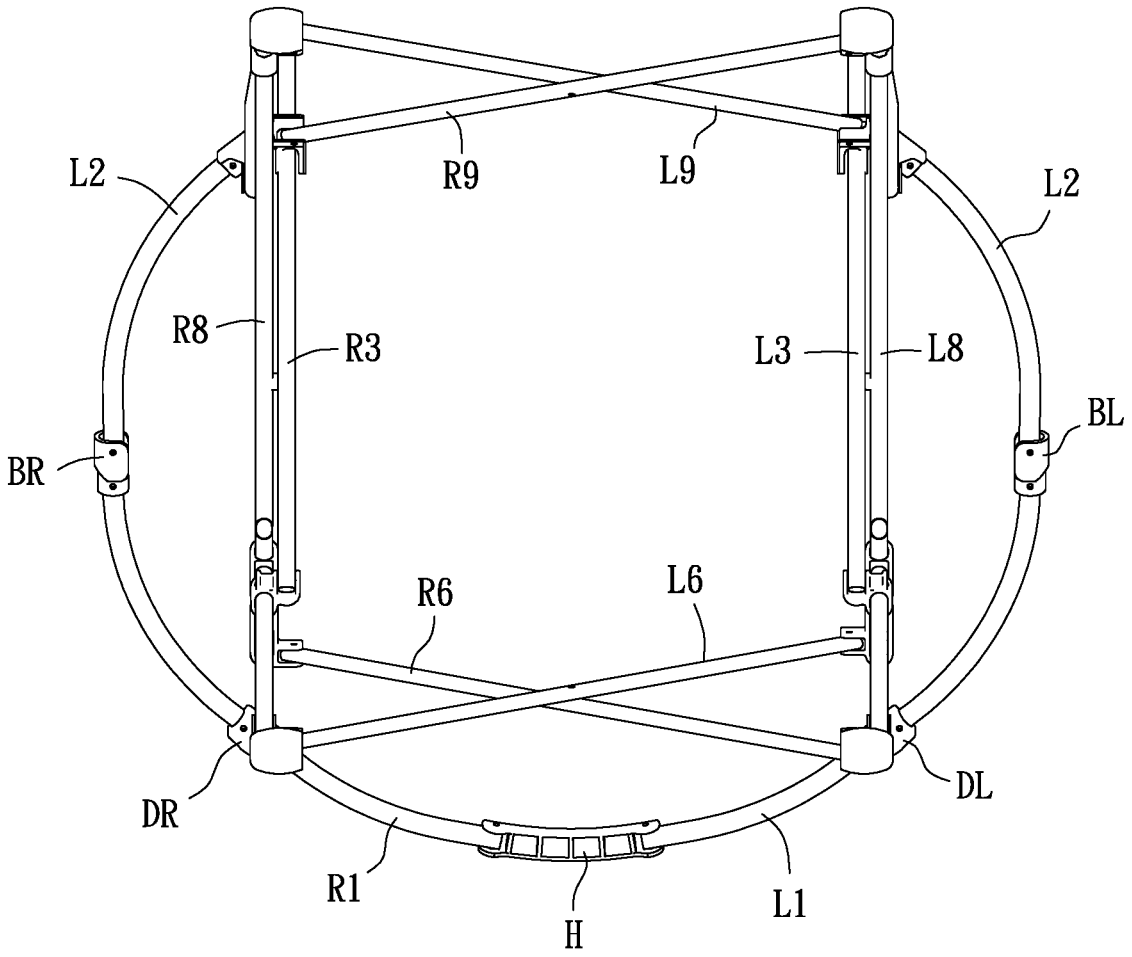
FIG. 5 is a bottom view of the folding chair according to the embodiment of the present disclosure.
Figure 6:
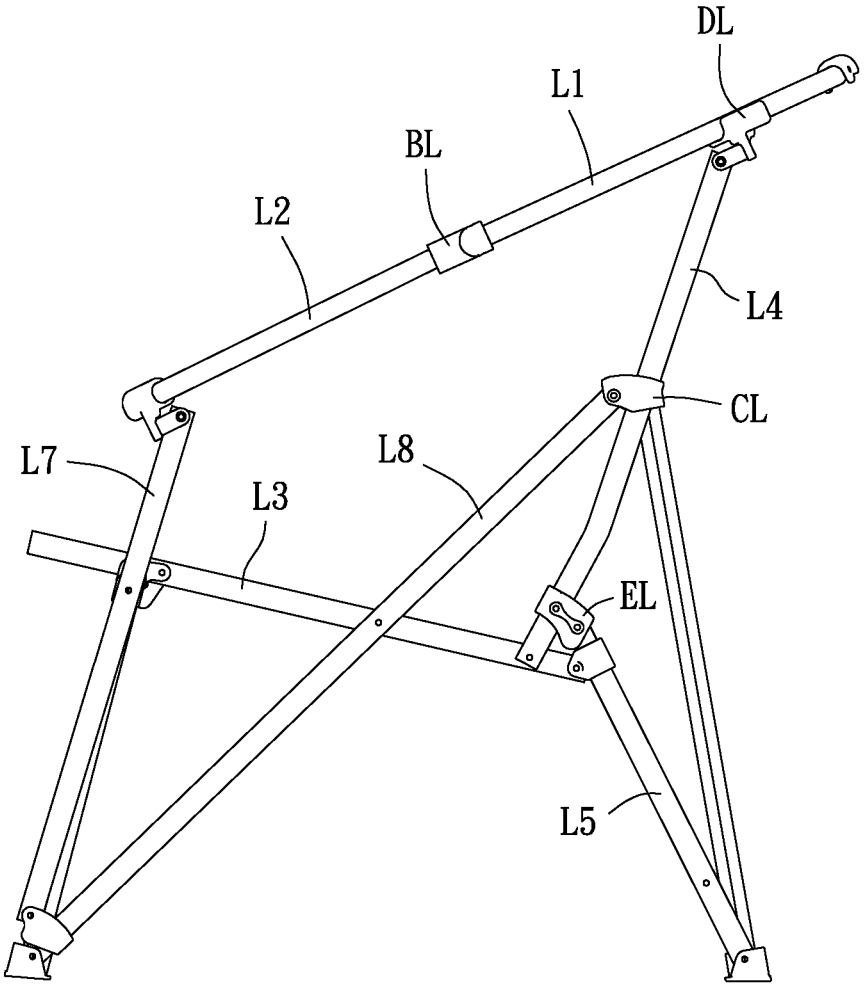
FIG. 6 is a right lateral view of the folding chair according to the embodiment of the present disclosure.
Figure 7:
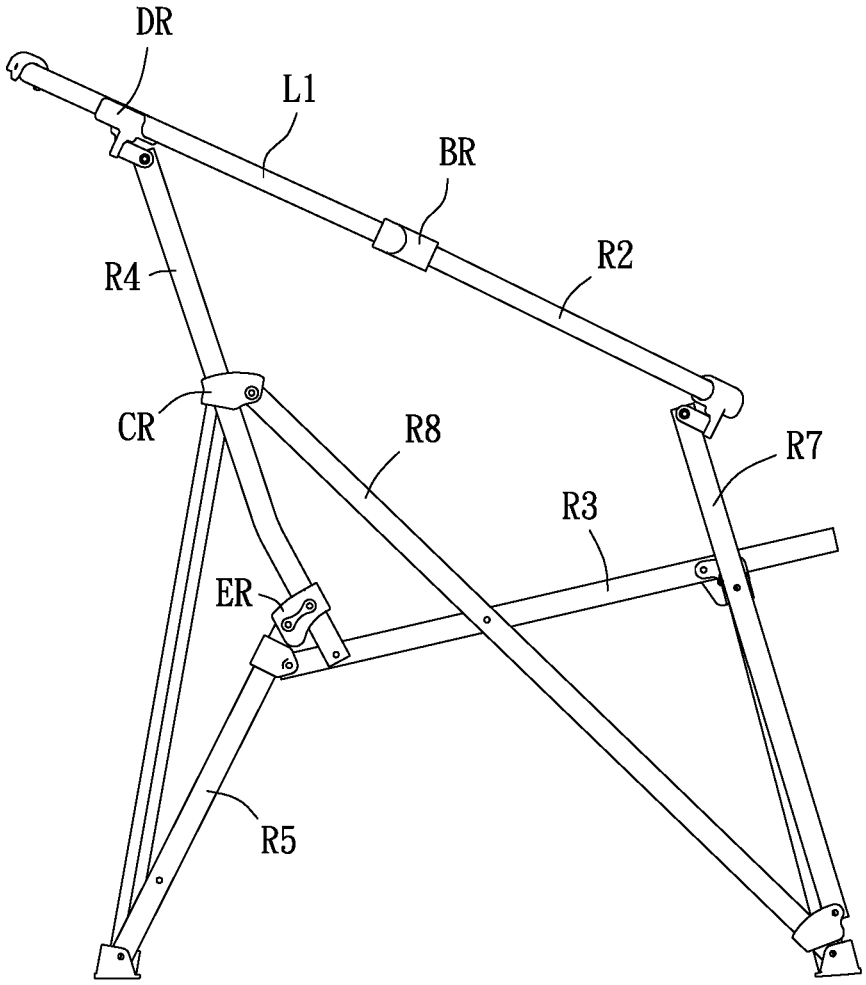
FIG. 7 is a left lateral view of the folding chair according to the embodiment of the present disclosure.

FIG. 1 and FIG. 2 are perspective views of a folding chair according to an embodiment of the present disclosure. FIG. 3 through FIG. 7 are different views of the folding chair according to the embodiment of the present disclosure. Referring to FIG. 1, FIG. 2, and FIG. 3 through FIG. 7, in the embodiment of the present disclosure, a folding chair 100 comprises a left back rest rod L1, a right back rest rod R1, a central handle H, a left handrail rod L2, a right handrail rod R2, a left frame rod L3, a right frame rod R3, a left back rest support rod L4, a right back rest support rod R4, a left rear rod L5, a right rear rod R5, a left rear crossing rod L6, a right rear crossing rod R6, a left handrail support rod L7, a right handrail support rod R7, a left front rod L8, a right front rod R8, a left front crossing rod L9, a right front crossing rod R9, a left handrail rotating element BL, a right handrail rotating element BR, a left back rest rotating element DL, a right back rest rotating element DR, a left support rod sliding element CL, a right support rod sliding element CR, a left rear rod sliding element EL, a right rear rod sliding element ER, a left frame rotating element FL, a right frame rotating element FR, a left handrail pivoting element L10, a right handrail pivoting element R10, a left support rod sliding element L11, a right support rod sliding element R11, a left front pedal PLF, a right front pedal PRF, a left rear pedal PLB, a right rear pedal PRB and a support portion S, and connections therebetween are described below.

The left handrail rod L2, left handrail rotating element BL, left back rest rod L1, central handle H, right back rest rod R1, right handrail rotating element BR and right handrail rod R2 are sequentially connected to form an arcuate skeleton providing a back rest and a handrail. The left back rest rod L1 and right back rest rod R1 are pivotally connected to each other by the central handle H. The left handrail rod L2 is pivotally connected to the left back rest rod L1 by the left handrail rotating element BL and thus rotates relative to the left back rest rod L1. Similarly, the right handrail rod R2 is pivotally connected to the right back rest rod R1 by the right handrail rotating element BR and thus rotates relative to the right back rest rod R1. The two ends of the central handle H are pivotally connected to the left back rest rod L1 and right back rest rod R1, respectively, such that the left back rest rod L1 and right back rest rod R1 rotate relative to the central handle H.

The upper end of the left back rest support rod L4 is pivotally connected to the upper ends of the left back rest rod L1 and the right back rest support rod R4 by the left back rest rotating element DL such that the right back rest rotating element DR is pivotally connected to the right back rest rod R1.

The lower end of the left back rest support rod L4 is pivotally connected to the upper end of the left rear rod L5 and the rear end of the left frame rod L3 by the left rear rod sliding element EL. The lower end of the right back rest support rod R4 is pivotally connected to the upper end of the right rear rod R5 and the rear end of the right frame rod R3 by the right rear rod sliding element ER.

The upper end of the left rear crossing rod L6 and the upper end of the left front rod L8 are movably connected to the left back rest support rod L4 by the left support rod sliding element CL. The upper end of the right rear crossing rod R6 and the upper end of the right front rod R8 are movably connected to the right back rest support rod by the right support rod sliding element CR.

The lower end of the left rear crossing rod L6 is pivotally connected to the lower end of the right rear rod R5 by the right rear pedal PRB. The lower end of the right rear crossing rod R6 is pivotally connected to the lower end of the left rear rod L5 by the left rear pedal PLB. The middle segment of the left rear crossing rod L6 is pivotally connected to the middle segment of the right rear crossing rod R6.

The middle segment of the left front rod L8 is pivotally connected to the middle segment of the left frame rod L3. The middle segment of the right front rod R8 is pivotally connected to the middle segment of the right frame rod R3.

The lower end of the left front rod L8 is pivotally connected to the lower end of the right front crossing rod R9 by the left front pedal PLF. The lower end of the left handrail support rod L7 is pivotally connected to and slid along the left front rod L8 because of the left support rod sliding element L11. The lower end of the right front rod R8 is pivotally connected to the lower end of the left front crossing rod L9 by the right front pedal PRF. The lower end of the right handrail support rod R7 is pivotally connected to and slid along the right front rod R8 by the right support rod sliding element R11. The middle segment of the left front crossing rod L9 is pivotally connected to the middle segment of the right front crossing rod R9.

The upper end of the left handrail support rod L7 is pivotally connected to the left handrail rod L2 by the left handrail pivoting element L10. The upper end of the right handrail support rod R7 is pivotally connected to the right handrail rod R2 by the right handrail pivoting element R10.

The front end of the left frame rod L3 and the upper end of the left front crossing rod L9 are movably connected to the left handrail support rod L7 by the left frame rotating element FL. The front end of the right frame rod R3 and the upper end of the right front crossing rod R9 are movably connected to the right handrail support rod R7 by the right frame rotating element FR.

The support portion S is disposed at the left back rest rod L1, right back rest rod R1, left handrail rod L2, right handrail rod R2, left frame rod L3 and right frame rod R3. The support portion S is, for example, made of a soft material, such as a fabric or a plastic, and is pivotally connected to the left back rest rod L1, right back rest rod R1, left handrail rod L2, right handrail rod R2, left frame rod L3 and right frame rod R3 in a coupled manner and thus form a seat and a back rest pad. However, the present disclosure is not limited thereto, as the support portion S may also be provided in any other form.

Figure 8:
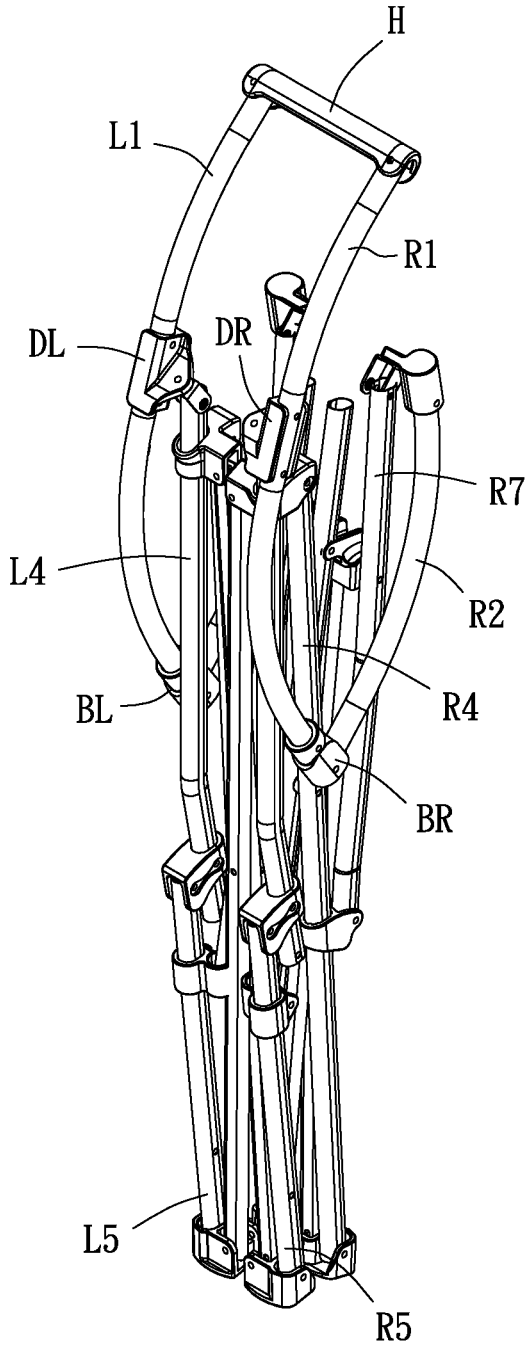
FIG. 8 is a perspective view of the folding chair folded according to the embodiment of the present disclosure.
Figure 9:
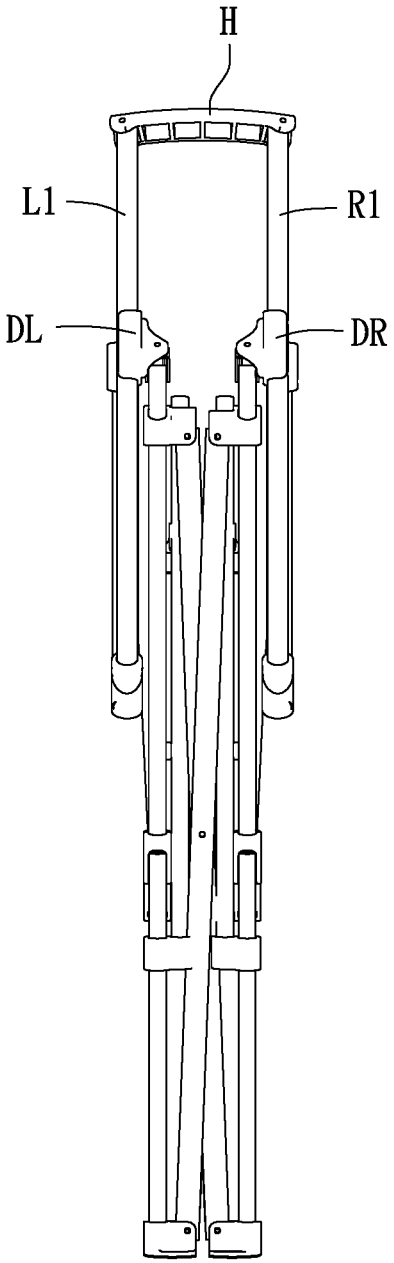
FIG. 9 is a rear view of the folding chair folded according to the embodiment of the present disclosure.
Figure 10:
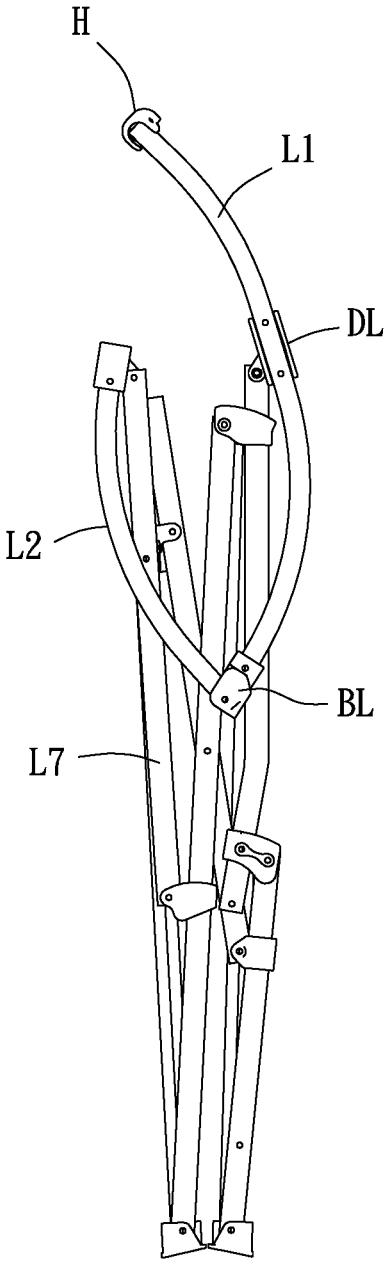
FIG. 10 is a left lateral view of the folding chair folded according to the embodiment of the present disclosure.

FIG. 1, FIG. 8 through FIG. 10 show how the folding chair 100 unfolded in FIG. 1 is folded as shown in FIG. 8 through FIG. 10. First, the user uses the left rear rod sliding element EL or the right rear rod sliding element ER as a fulcrum and folds the front end of the left frame rod L3 or the front end of the right frame rod R3 toward the central handle H; meanwhile, the middle segments of the left frame rod L3 and the right frame rod R3 cause the middle segments of the right front rod R8 and the left front rod L8 to rotate.

The front end of the left frame rod L3 and the front end of the right frame rod R3 move upward along the left handrail support rod L7 and the right handrail support rod R7 through the left frame rotating element FL and the right frame rotating element FR. Upon arrival at the top ends of the left handrail support rod L7 and the right handrail support rod R7, the front end of the left frame rod L3 and the front end of the right frame rod R3 drive the left handrail support rod L7 and the right handrail support rod R7, respectively, to approach the central handle H. The lower end of the left handrail support rod L7 and the lower end of the right handrail support rod R7 move upward along the left front rod L8 and the right front rod R8 by the left support rod sliding element L11 and the right support rod sliding element R11, respectively. Folding the left frame rod L3 and the right frame rod R3 toward the central handle H is accompanied by rotating and folding the left front crossing rod L9 and the right front crossing rod R9 toward the middle.

When the left frame rod L3 and the right frame rod R3 are folding toward the central handle H, both the lower portion of the left rear rod sliding element EL and the lower portion of the right rear rod sliding element ER slide downward along the left rear rod L5 and the right rear rod R5, respectively, to drive the left rear rod L5 and the right rear rod R5 to fold inward.

At this moment, the left back rest support rod L4 and the right back rest support rod R4 rotate inward and cause the upper ends of the right front rod R8 and the left front rod L8 and the upper ends of the right rear crossing rod R6 and the left rear crossing rod L6 to move upward and centrally through the left support rod sliding element CL and the right support rod sliding element CR.

The left back rest rod L1 and the right back rest rod R1 rotate relative to the central handle H. The left handrail rod L2 and the right handrail rod R2 rotate relative to the left back rest rod L1 and the right back rest rod R1. Therefore, the folding chair 100 has been fully folded.

Therefore, the folding chair 100 changes from the unfolded state of FIG. 1 to the folded state of FIG. 8 and thus takes up less space. Hence, the folding chair 100 is easy to transport and store.

Figure 11:
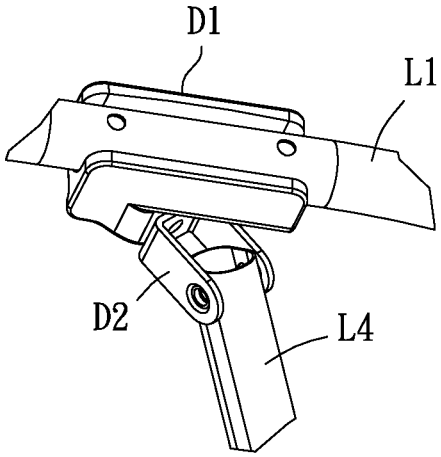
FIG. 11 is a perspective view of left back rest rotating element of the folding chair according to the embodiment of the present disclosure.

In an embodiment illustrated by FIG. 11 and exemplified by the left back rest rotating element DL, mirror symmetry is manifested between, and the same structure is shared by, the left back rest rotating element DL and the right back rest rotating element DR, and thus the diagram does not show the right back rest rotating element DR. In this embodiment, the left back rest rotating element DL comprises a sleeve portion D1 and a pivotal portion D2 connected to the sleeve portion D1. The sleeve portion D1 is disposed at the left back rest rod L1. The left back rest support rod L4 is pivotally connected to the left back rest rod L1 through the pivotal portion D2. Similarly, the right back rest rotating element DR comprises a sleeve portion D1 and a pivotal portion D2 connected to the sleeve portion D1. The sleeve portion D1 is disposed at the right back rest rod R1. The right back rest support rod R4 is pivotally connected to the back rest rod R1 through the pivotal portion D2. Therefore, the degree of freedom by which the left back rest support rod L4 and the right back rest support rod R4 rotate relative to the left back rest rod L1 and the right back rest rod R1 increase greatly.

Figure 12:
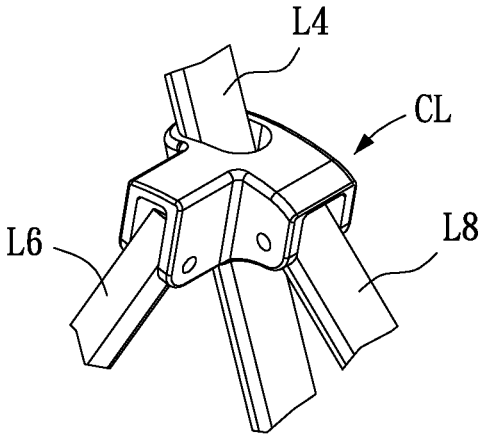
FIG. 12 is a perspective view of left support rod sliding element of the folding chair according to the embodiment of the present disclosure.

In an embodiment illustrated by FIG. 12 and exemplified by the left support rod sliding element CL, mirror symmetry is manifested between, and the same structure is shared by, the left support rod sliding element CL and the right support rod sliding element CR, and thus the diagram does not show the right support rod sliding element CR. In this embodiment, as shown in FIG. 12, the left rear crossing rod L6 and the left front rod L8 are pivotally connected to the left support rod sliding element CL and thus rotate relative to the left support rod sliding element CL, whereas the left support rod sliding element CL is slidingly, fittingly disposed at the left back rest support rod L4 such that the left support rod sliding element CL drives the left rear crossing rod L6 and the left front rod L8 to slide along the left back rest support rod L4. Similarly, the right rear crossing rod R6 and the right front rod R8 are pivotally connected to the right support rod sliding element CR, and thus the right support rod sliding element CR is slidingly, fittingly disposed at the right back rest support rod R4.

Figure 13:
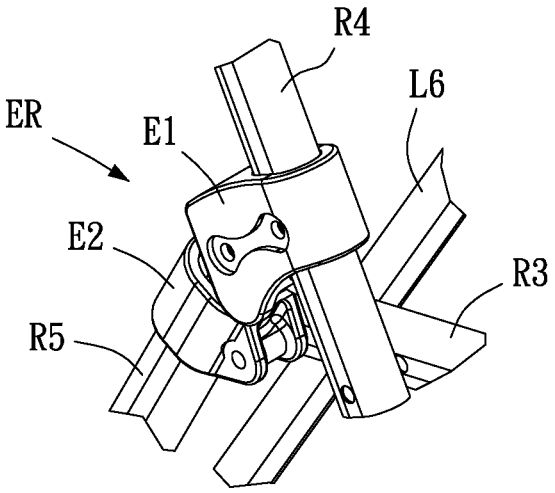
FIG. 13 is a perspective view of right rear rod sliding element of the folding chair according to the embodiment of the present disclosure.

In an embodiment illustrated by FIG. 13 and exemplified by the right rear rod sliding element ER, mirror symmetry is manifested between, and the same structure is shared by, the left rear rod sliding element EL and the right rear rod sliding element ER, and thus the diagram does not show the left rear rod sliding element EL. In this embodiment, as shown in FIG. 13, the lower end of the right back rest support rod R4 is pivotally connected to the rear end of the right frame rod R3, whereas the right rear rod sliding element ER has a sleeve portion E1 and a pivotal portion E2, and the upper end of the right rear rod R5 is slidingly, fittingly disposed at the pivotal portion E2 and pivotally connected to sleeve portion E1, wherein the upper end of the right rear rod R5 is pivotally connected to the rear end of the right frame rod R3 through the pivotal portion E2, allowing the sleeve portion E1 to fit around the right back rest support rod R4. Similarly, the lower end of the left back rest support rod L4 is pivotally connected to the rear end of the left frame rod L3, and the left rear rod sliding element EL has a sleeve portion E1 and a pivotal portion E2, wherein the upper end of the left rear rod L5 is slidingly, fittingly disposed at the pivotal portion E2, pivotally connected to sleeve portion E1, and pivotally connected to the rear end of the left frame rod L3 through the pivotal portion E2, thereby allowing the sleeve portion E1 to fit around the left back rest support rod L4.

Figure 14:
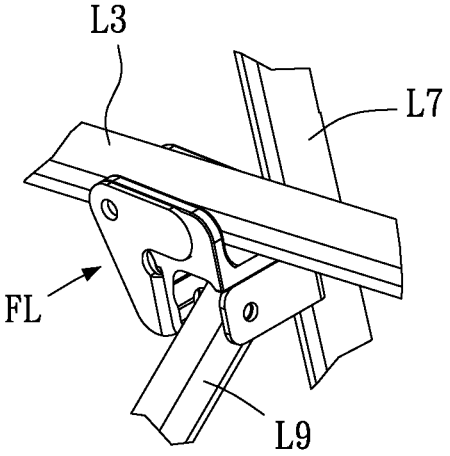
FIG. 14 is a perspective view of left frame rotating element of the folding chair according to the embodiment of the present disclosure.

In an embodiment illustrated by FIG. 14 and exemplified by the left frame rotating element FL, mirror symmetry is manifested between, and the same structure is shared by, the left frame rotating element FL and the right frame rotating element FR, and thus the diagram does not show the right frame rotating element FR. In this embodiment, as shown in FIG. 14, the front end of the left frame rod L3 is pivotally connected to the left frame rotating element FL, whereas the upper end of the left front crossing rod L9 is pivotally disposed at the left frame rotating element FL. Similarly, the front end of the right frame rod R3 is pivotally connected to the right frame rotating element FR, whereas the upper end of the right front crossing rod R9 is pivotally disposed at the right frame rotating element FR.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A folding chair, comprising a left back rest rod, a right back rest rod, a central handle, a left handrail rod, a right handrail rod, a left frame rod, a right frame rod, a left back rest support rod, a right back rest support rod, a left rear rod, a right rear rod, a left rear crossing rod, a right rear crossing rod, a left handrail support rod, a right handrail support rod, a left front rod, a right front rod, a left front crossing rod, a right front crossing rod, a left handrail rotating element, a right handrail rotating element, a left back rest rotating element, a right back rest rotating element, a left support rod sliding element, a right support rod sliding element, a left rear rod sliding element, a right rear rod sliding element, a left frame rotating element, a right frame rotating element, a left handrail pivoting element, a right handrail pivoting element, a left support rod sliding element, a right support rod sliding element, a left front pedal, a right front pedal, a left rear pedal, a right rear pedal and a support portion, wherein the left handrail rod, the left handrail rotating element, the left back rest rod, the central handle, the right back rest rod, the right handrail rotating element and the right handrail rod are sequentially connected, allowing the left back rest rod and the right back rest rod to be pivotally connected to each other by the central handle, the left handrail rod being pivotally connected to the left back rest rod by the left handrail rotating element, and the right handrail rod being pivotally connected to the right back rest rod by the right handrail rotating element, wherein an upper end of the left back rest support rod is pivotally connected to the left back rest rod by the left back rest rotating element, an upper end of the right back rest support rod is pivotally connected to the right back rest rod by the right back rest rotating element, a lower end of the left back rest support rod is pivotally connected to an upper end of the left rear rod and a rear end of the left frame rod by the left rear rod sliding element, a lower end of the right back rest support rod is pivotally connected to an upper end of the right rear rod and a rear end of the right frame rod by the right rear rod sliding element, wherein an upper end of the left rear crossing rod and an upper end of the left front rod are movably connected to the left back rest support rod by the left support rod sliding element, an upper end of the right rear crossing rod and an upper end of the right front rod are movably connected to the right back rest support rod by the right support rod sliding element, wherein a lower end of the left rear crossing rod is pivotally connected to a lower end of the right rear rod by the right rear pedal, a lower end of the right rear crossing rod is pivotally connected to a lower end of the left rear rod by the left rear pedal, a middle segment of the left rear crossing rod is pivotally connected to a middle segment of the right rear crossing rod, wherein a middle segment of the left front rod is pivotally connected to a middle segment of the left frame rod, and a middle segment of the right front rod is pivotally connected to a middle segment of the right frame rod, wherein a lower end of the left front rod is pivotally connected to a lower end of the right front crossing rod by the left front pedal, a lower end of the left handrail support rod is pivotally connected to and slid along the left front rod by the left support rod sliding element, a lower end of the right front rod is pivotally connected to a lower end of the left front crossing rod by the right front pedal, a lower end of the right handrail support rod is pivotally connected to and slid along the right front rod by the right support rod sliding element, and a middle segment of the left front crossing rod is pivotally connected to a middle segment of the right front crossing rod, wherein an upper end of the left handrail support rod is pivotally connected to the left handrail rod by the left handrail pivoting element, and an upper end of the right handrail support rod is pivotally connected to the right handrail rod by the right handrail pivoting element, wherein a front end of the left frame rod and an upper end of the left front crossing rod are movably connected to the left handrail support rod by the left frame rotating element, wherein a front end of the right frame rod and an upper end of the right front crossing rod are movably connected to the right handrail support rod by the right frame rotating element, and wherein the support portion is disposed at the left back rest rod, the right back rest rod, the left handrail rod, the right handrail rod, the left frame rod and the right frame rod.

2. The folding chair of claim 1, wherein the left back rest rotating element comprises a sleeve portion and a pivotal portion connected to the sleeve portion, the sleeve portion being disposed at the left back rest rod, the left back rest support rod being pivotally connected to the left back rest rod through the pivotal portion, the right back rest rotating element comprising a sleeve portion and a pivotal portion connected to the sleeve portion, the sleeve portion being disposed at the right back rest rod, and the right back rest support rod being pivotally connected to the back rest rod through the pivotal portion.

3. The folding chair of claim 1, wherein the left rear crossing rod and the left front rod are pivotally connected to the left support rod sliding element, the left support rod sliding element being slidingly, fittingly disposed at the left back rest support rod, wherein the right rear crossing rod and the right front rod are pivotally connected to the right support rod sliding element, the right support rod sliding element being slidingly, fittingly disposed at the right back rest support rod.

4. The folding chair of claim 1, wherein the lower end of the left back rest support rod is pivotally connected to the rear end of the left frame rod, whereas the left rear rod sliding element has a sleeve portion and a pivotal portion, and an upper end of the left rear rod is slidingly, fittingly disposed at the pivotal portion and thereby pivotally connected to the sleeve portion, wherein an upper end of the left rear rod is pivotally connected to the rear end of the left frame rod by the pivotal portion, with the sleeve portion fitting around the left back rest support rod, wherein the lower end of the right back rest support rod is pivotally connected to the rear end of the right frame rod, wherein the right rear rod sliding element has a sleeve portion and a pivotal portion, whereas an upper end of the right rear rod is slidingly, fittingly disposed at the pivotal portion, pivotally connected to the sleeve portion, and pivotally connected to the rear end of the right frame rod through the pivotal portion, with the sleeve portion fitting around the right back rest support rod.

5. The folding chair of claim 1, wherein the front end of the left frame rod is pivotally connected to the left frame rotating element, the upper end of the left front crossing rod is pivotally disposed at the left frame rotating element, the front end of the right frame rod is pivotally connected to the right frame rotating element, the upper end of the right front crossing rod is pivotally disposed at the right frame rotating element.

* * * * *